US005141073A

United States Patent [19]

Pelonis

[11] Patent Number: 5,141,073

[45] Date of Patent: Aug. 25, 1992

[54] TRAPEZOIDAL SOUND ABSORPTION MODULE

[76] Inventor: Chris A. Pelonis, 9231 Lakewood Blvd., Downey, Calif. 90240

[21] Appl. No.: 573,360

[22] Filed: Aug. 27, 1990

[51] Int. Cl.[5] ..... E04B 1/99

[52] U.S. Cl. ..... 181/30; 181/295; 181/296

[58] Field of Search ..... 181/30, 295, 296

[56] References Cited

U.S. PATENT DOCUMENTS

| | | | |
|---|---|---|---|
| 3,819,010 | 6/1974 | Adams et al. | 181/295 X |
| 4,316,522 | 2/1982 | Hirschorn | 181/224 |
| 4,989,688 | 2/1991 | Nelson | 181/295 X |

*Primary Examiner*—L. T. Hix
*Assistant Examiner*—Khanh Dang
*Attorney, Agent, or Firm*—Charles H. Thomas

[57] ABSTRACT

A trapezoidal-shaped acoustic absorber is designed for use in music recording studios. The absorber is configured in the shape of a right trapezoidal prism and has an internal transverse pegboard partition which divides the absorber into a plurality of chambers. Each of the chambers is lined with fiberglass sound insulation padding and is resonant to a different frequency. The unit as a whole is resonant to still another frequency. A plurality of the modules are assembled together to line the walls or ceiling of a room so as to render the room suitable for mixing and recording musical sounds. The modular units are portable and allow audio recording and mixing to be formed in virtually any room without the necessity for access to a specially designed recording studio.

15 Claims, 3 Drawing Sheets

TRAPEZOIDAL SOUND ABSORPTION MODULE

BACKGROUND OF THE INVENTION

1. Field of the Invention

The present invention is directed to a sound absorption system for the acoustic treatment of sound, a modular sound absorption unit employed in such a system, and a method of mixing and recording musical sounds using a trapezoidal modular sound absorption unit.

2. Description of the Prior Art

At present, music is professionally recorded on phonographic tapes and records in musical sound recording studios. Such sound recording studios are constructed as enclosed rooms in which the walls and ceilings are lined with sound absorption material. Either live sound or prerecorded sound, or combinations of live and prerecorded sounds are monitored and mixed at an electronic recording console. The sound absorption material on the walls and ceiling of a recording studio attenuates incident sound and mutes sound reflections and reverberations so that the pure sound from the sources of music to be recorded is not degraded by echoes or ambient noise.

While high quality musical recordings can be produced by mixing sound from different sources in a professional sound recording studio, access to such studios is often limited and the cost of renting a recording studio is extremely high. Time in professional sound recording studios is so precious that the studios are often rented for only a few hours at a time and at an extremely high rate. Furthermore, the limited periods for which such sound recording studios are available for mixing sound for any particular recording, and the high cost of rental creates considerable pressure on the individuals who control the mixing of the sounds since there is little opportunity to repeat the mixing and recording process. In addition, any repetition which is possible to achieve a recording with optimally mixed sound is possible only by payment of a high premium.

SUMMARY OF THE INVENTION

The present invention involves a system that employs portable, modular sound absorption units which allow musical sounds to be mixed and recorded in virtually any room. By utilizing a plurality of the sound absorption modules constructed according to the invention a user can temporarily transform a room of a dwelling or office into a sound recording studio which allows sound from different sources to be mixed and recorded in a highly professional manner. This greatly increases the opportunities for musicians of limited means to create high quality musical sound recordings. Furthermore, because the mixing and recording of musical sounds can be accomplished in the room of a home or office, a musician is greatly relieved from the financial pressure and the pressure of time that is involved in recording musical sounds in a specially designed sound recording studio. The absence of such pressures allows a musician much greater flexibility to experiment with different sound mixes and to repeat the sound mixing process as often as desired to obtain the optimum recording sought.

A very important feature of the invention is the ability of the modular sound absorption units to attenuate, absorb and reflect sound across a broad frequency spectrum. The sounds of low frequency which are far more pervasive than high frequency sounds are absorbed to a considerable degree, especially those sounds below 500 hertz. As frequency rises the unit gradually exhibits less sound absorption and a greater degree of sound reflection. The modular sound absorption units are each configured in the shape of a trapezoidal prism. An internal partition within the trapezoidal prism-shaped cavity of the unit divides the cavity into a plurality of compartments each of which is resonant to a different frequency. Also, the modular unit as a whole is resonant to still another frequency.

As a consequence of this compartmentalized construction the sound is absorbed and reflected internally within the unit, and ultimately absorbed within a plurality of such units, so that it is not reflected from the wall and ceiling surfaces of the room back toward the sound mixing equipment. The use of a plurality of such modular sound absorption units allows musical sound to be mixed and recorded in rooms that would otherwise be totally unacceptable for that purpose. The units are quite portable, however, and can be stored when not in use so that normal, everyday activities can be carried out in the room.

By constructing the modular sound absorption units as trapezoidal prisms, sound can be effectively muted and absorbed within the units in a highly efficient manner. Each unit is preferably shaped as a right trapezoidal prism. That is, each unit has a uniform trapezoidal cross section and has a long, parallel side; a short, parallel side; a long, non-parallel side; and a short, non-parallel side. The two parallel sides are each connected at right angles to the short, non-parallel side at their first ends. The parallel sides are connected at their second ends to the ends of the long, non-parallel side.

The long, non-parallel side of the unit is normally oriented obliquely relative to the sound sources and the mixing console so that sound is not reflected back to the mixing console. The short, non-parallel side of the unit is often juxtaposed against a wall or ceiling surface or against the short, non parallel side of an adjacent unit. By constructing the units with a trapezoidal cross section there is always some thickness between the non parallel sides of the unit, since the minimum thickness is the length of the shorter of the two parallel sides. Some thickness throughout the width of the unit is necessary to allow the absorption of low frequency sound.

In one broad aspect the present invention may be considered to be a sound absorption system for use in mixing and recording musical sounds and including at least one modular sound absorption unit. This unit is comprised of a plurality of linear frame members joined together to form a framework having linear edges. A plurality of stiff, flat, expansive sheets having a multiplicity of apertures therethrough are provided. These sheets include exterior sheets that extend between the framework edges to enclose a cavity shaped as a trapezoidal prism and an interior sheet dividing the cavity into separate compartments. Layers of sound insulation are disposed within each of the compartments.

In another broad aspect the invention may be considered to be a modular sound absorption unit comprising linear members joined together to frame a trapezoidal prism with sides including a longest side and edges formed by at least some of the linear members. The unit includes flat, expansive exterior sheets each having a multiplicity of apertures therethrough. The sheets are secured to the linear members to close all of the sides of the trapezoidal prism. An interior partition extends from the longest side of the prism to an edge opposite the longest side to divide the cavity into internal compartments of differing geometry. Porous layers of sound insulation are disposed internally of the exterior sheets and in contact with all of the exterior sheets, and preferably with the partition also.

The partition is preferably comprised of a stiff, flat, expansive sheet having a multiplicity of apertures therethrough constructed of the same material as the exterior sheets. The partition and exterior sheets are preferably pegboard and the linear members framing the trapezoidal prism are preferably wooden furring strips. The porous layers of sound insulation are preferably comprised of fiberglass wool insulation padding of the type employed primarily for thermal insulation in building construction. Building insulation of a rating of R-19 may be advantageously employed for this purpose. Such padding forms a very effective acoustic insulation.

The wooden linear furring strip members are disposed externally of all but one of the exterior pegboard sheets to define an exposed framework with all but one of the exterior pegboard sheets encompassed therewithin. One pegboard sheet must be mounted externally on the framework so as to allow access to the interior for insulation of the partition and the layers of insulation. This construction allows the trapezoidal prism shaped modules to be hung from the ceiling by ceiling hangers which are anchored in the ceiling of a room. The hooks of the ceiling hangers may merely be twisted to the side to allow the trapezoidal prism-shaped modules to be placed up against the ceiling. The hooks are then turned back so that the furring strips of the framework reset upon them, whereby the units are held against the ceiling. Modules mounted on the wall can normally stand upright without any anchoring system.

The exterior pegboard sheets are preferably internally lined with a fabric, such as muslin. The muslin fabric confines particles of fiberglass that fall loose from the padding within the trapezoidal prism-shaped cavity of the unit, and prevents the particles from dropping into the room in which the unit is deployed.

In still another aspect the invention may be considered to be an improvement in a method of mixing and recording musical sounds in an enclosed room in which at least one source of music is located. The improvement is comprised of positioning within the room at least one sound absorption module comprising: a framework shaped with edges outlining a trapezoidal prism and formed by linear frame members joined together, flat expansive sheets having a multiplicity of apertures therethrough extending between the linear members to enclose a cavity shaped as a trapezoidal prism, a flat interior partition dividing the cavity into separate compartments, and layers of porous insulation lining the separate compartments.

According to the method of the invention a plurality of sound absorption units as aforesaid are employed wherein the sound absorption units are all formed as right trapezoidal prisms of identical construction, each having a long, parallel side; a short, parallel side; a long, nonparallel side; and a short, non-parallel side. At least some of the sound absorption units are positioned in juxtaposition relative to each other.

In one arrangement at least some of the juxtaposed units are arranged with their short, parallel sides in face to face contact with each other, so that the long, non-parallel sides of those units form a dihedral having an obtuse angle that encompasses the music source and audio recorder. In another arrangement the long, parallel sides of adjacent units are disposed in mutually facing relationship so that the long, non-parallel sides of those units form a dihedral having a reflex angle that encompasses the source of music and the audio recorder. In still another arrangement at least some of the juxtaposed units are positioned with their short, parallel sides in coplanar relationship and their short, non-parallel sides in back to back arrangement, whereby the juxtaposed units form an anechoic trap.

The invention may be described with greater clarity and particularity with reference to the accompanying drawings.

DESCRIPTION OF THE EMBODIMENT AND IMPLEMENTATION OF THE METHOD

Figure 1:
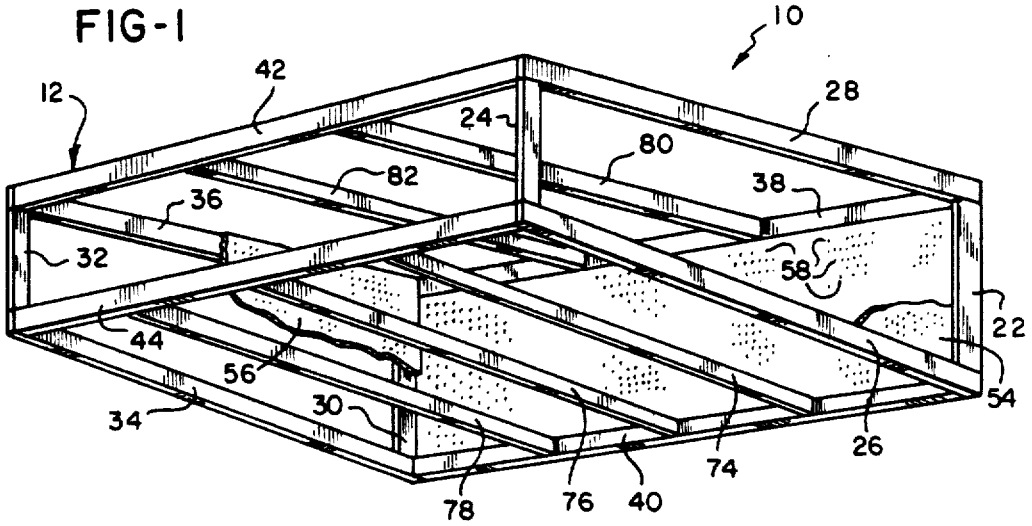
FIG. 1 is a perspective view showing the framework of a single sound absorption unit according to the invention.
Figure 2:
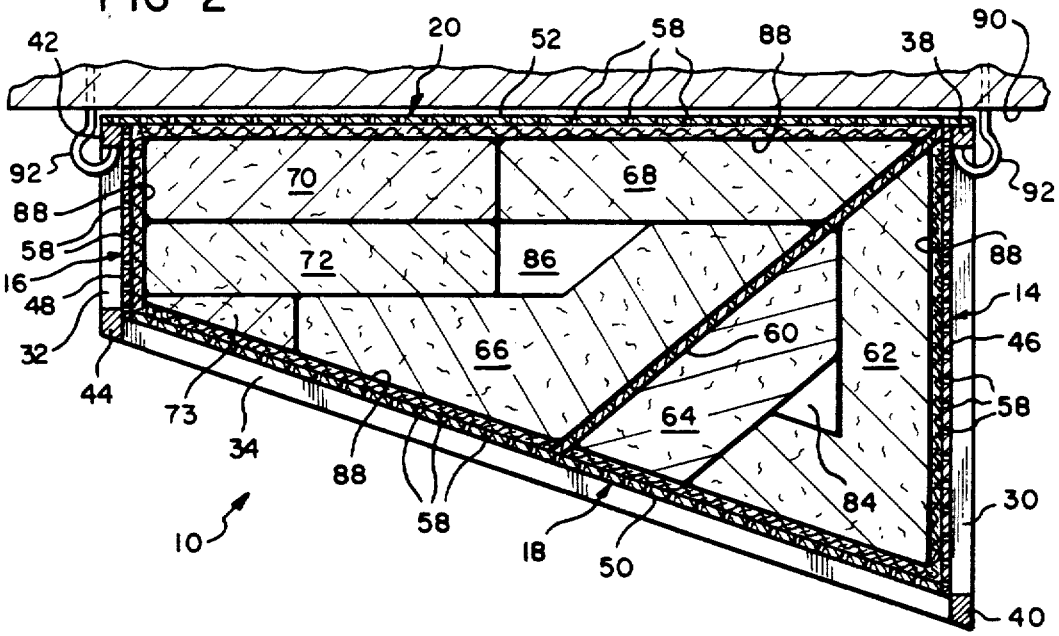
FIG. 2 is a sectional elevational view of a single fully assembled sound absorption unit according to the invention.

The construction of a single sound absorption unit 10 according to the invention is illustrated in FIGS. 1 and 2. The sound absorption unit 10 is comprised of a framework 12 which defines an enclosure in the shape of a trapezoidal prism. As illustrated in FIG. 2, the trapezoidal cross section of the enclosure defined by the framework 12 has four sides, including a long, parallel side 14; a short, parallel side 16; a long, non-parallel side 18; and a short, non-parallel side 20. The configuration of the framework 12 is such that the cavity enclosed is shaped as a right trapezoidal prism. That is, the short, non-parallel side 20 is perpendicular to and joins the first ends of the two parallel sides 14 and 16 at right angles therewith. The long, non-parallel side 18 is the longest side of the entire structure and is connected to the second ends of the parallel sides 14 and 16 so that the enclosed cavity within the framework 12 is of uniform trapezoidal cross section throughout.

The edges of the framework 12 are formed by linear wooden furring strips 22–44. Flat expansive exterior pegboard sheets 46–56, each having a multiplicity of apertures 58 therethrough, are secured to the linear members 22–44 to close all of t he sides 14–20 of the trapezoidal prism. An interior pegboard partition 60 extends from the longest side 18 of the trapezoidal prism to the edge formed by the furring strip 38 opposite the side 18. Porous layers 62–72 of R-19 fiberglass sound insulation padding are disposed interiorally of the exterior sheets 46–56 and in contact with those sheets.

The modular sound absorption unit 10 is portable. Preferably, the wooden strips 24 and 32 extending along the end edges of the short, parallel side 16 are formed of two inch by three quarter inch furring strips which are seven inches in length. The strips 22 and 30 of the framework 12 which run parallel to the strips 24 and 32 along the end edges of the long. parallel side 14 are preferably formed of one and one-half by three quarter inch furring strips which are twenty one inches in length. The linear members 28 and 36 which form the end edges of the short, parallel side 20 are preferably formed of two inch by three quarter inch furring strips that are forty eight inches in length. The linear members 26 and 34 which extend along the end edges of the long, non-parallel side 18 are preferably formed of two inch by three quarter inch furring strips that are fifty inches in length.

The frame members 22, 24, 26 and 28 thereby define a right trapezoid at one end of the framework 12 which is congruent to a right trapezoid formed at the opposite end of the framework 12 by the frame members 30, 32, 34 and 36. These two opposite ends of the framework 12 are joined together by longitudinal connecting members 38, 40, 42 and 44 which are all of equal length. The longitudinal connecting members 38–44 are all preferably constructed of two inch by three quarter inch wooden furring strips which are eight feet in length.

To increase the rigidity of the framework 12 three transverse braces 74, 76 and 78, each formed of two inch by three quarter inch wooden furring strips, are secured at equal intervals along the linear members 40 and 44 to extend therebetween. Similarly, a pair of transverse cross braces 80 and 82, also formed of two inch by three quarter inch wooden furring strips, are spaced at equal intervals along the linear members 38 and 42 to extend therebetween. All of the wooden frame members 22–44 and 74–82 are nailed, screwed and glued together.

The flat, expansive sheets 46–56 are all formed of composition pegboard of between one eighth inch and one quarter inch in thickness. The exterior pegboard sheets 46–56 thereby define a cavity therewithin having the shape of a right trapezoidal prism. The exterior pegboard sheets 46–56 are secured to the framework 12 by glue and by nailing.

Within the cavity defined by the exterior pegboard sheets 46–56 the internal pegboard sheet 60 extends from the edge of the framework 12 formed at the junction between the exterior pegboard sheets 46 and 52 to the opposite, exterior pegboard sheet 50 that forms the longest side 18 of the sound absorption unit 10. The width of the pegboard sheet 60 that extends between the junction of the exterior pegboard sheets 46 and 52 and the opposite pegboard sheet 50 is preferably twenty four inches. The interior partition 60 thereby divides the enclosed volume within the exterior sheets 46–56 into two separate compartments 84 and 86, as illustrated in FIG. 2.

The internal surfaces of the exterior pegboard sheets 46–56 are lined with cotton muslin fabric, indicated at 88 in FIG. 2. Within the compartment 84 there are a pair of layers 62 and 64 of R-19 fiberglass insulation, six and one-half inches thick, oriented against the muslin lining 88 on the inner surfaces of the exterior pegboard sheets 46 and 50, and against the partition 60 as depicted in FIG. 2. A small portion of the compartment 84 is left unoccupied and vacant, as illustrated. Similarly, R-19 fiberglass muslin lining 88 on the inner surfaces of the exterior sheets 50, 48 and 52 and against the partition 60, as illustrated in FIG. 2. A portion of the volume of the compartment 86 is also left unoccupied by the fiberglass insulation layers 66–73.

As illustrated in FIG. 2, the wooden linear members 22–44 of the framework 12 are disposed externally of all of the exterior apertured sheets 46–56 except the sheet 52 to define an exposed framework 12 with the exterior expansive sheets 46–50, 54 and 56 encompassed therewithin. This allows the modular sound absorption unit 10 to be hung from a ceiling 90 by means of ceiling hangers 92, as illustrated in FIG. 2. To install the sound absorption module 10 as illustrated, the hooks of the ceiling hangers 92 are merely twisted away from each other so that the sound absorption module 10 can pass between them and can be pressed up against the ceiling 90 with the short, non-parallel side 52 disposed adjacent to and facing the ceiling 90. The hooks of the ceiling hangers 92 are then counter rotated about their own axes toward each other so as to reside directly beneath the members 38 and 42, which rest thereon as illustrated in FIG. 2. The exposed, skeletal framework 12 is thereby accessible for engagement by the ceiling hangers 92. ceiling hangers 92.

When the sound absorption module 10 is deployed against a wall, the short, non-parallel side 52, or the long, parallel side 46 is normally disposed to face the wall. The unit rests on an end upon either the linear members 22–28 or the members 30 36 of the framework 12 without any need for physical connection to the wall surfaces.

The geometric proportions of the modular sound absorption module 10 described in conjunction with FIGS. 1 and 2 represent the preferred embodiment of the modular unit. In the preferred embodiment the short, parallel side 16 of the trapezoidal prism is preferably about one third the length of the long, parallel side 14 and is separated from the long, parallel side 14 by a distance more than two times the width of the long, parallel side 14. That is, the short, non-parallel side 20 is preferably more that two times the width of the long parallel side 14.

When the unit 10 is configured in this manner the chambers 84 and 86 both resonate at frequencies below 400 hertz. Typically, the resonant frequency of both of the chambers 84 and 86 is between about 250 and 390 hertz. Furthermore, the entire trapezoidal prism volume enclosed within the exterior sheets 46–56 also resonates at a very low frequency which is below 400 hertz. By providing internal resonance at such low frequencies the pervading low frequency sound waves which are so difficult to attenuate are internally reverberated and absorbed within the sound absorption module 10.

The geometric proportions of the sound absorption module 10 are not restricted to those of the preferred embodiment, however. Indeed, these proportions can change significantly. For example, while the short, parallel side 16 of the enclosed right trapezoidal prism is preferably about one third the width of the long, parallel side 14, it can vary as much as forty percent relative to the long, parallel side and still provide highly effective sound insulation. Furthermore, the relative sizes of the compartments 84 and 86 within the enclosed right triangular prism can be varied significantly while still providing excellent sound absorption over a broad frequency range.

Figure 3:
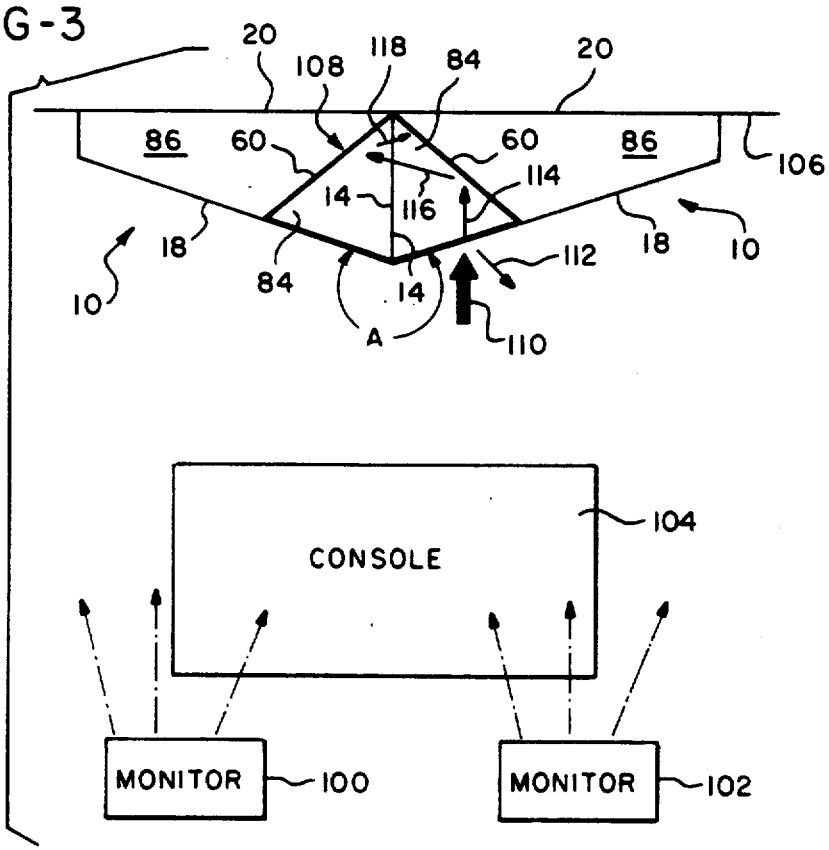
FIG. 3 is a top plan view showing one manner of deploying a plurality of sound absorption units according to the method of the invention.
Figure 5:
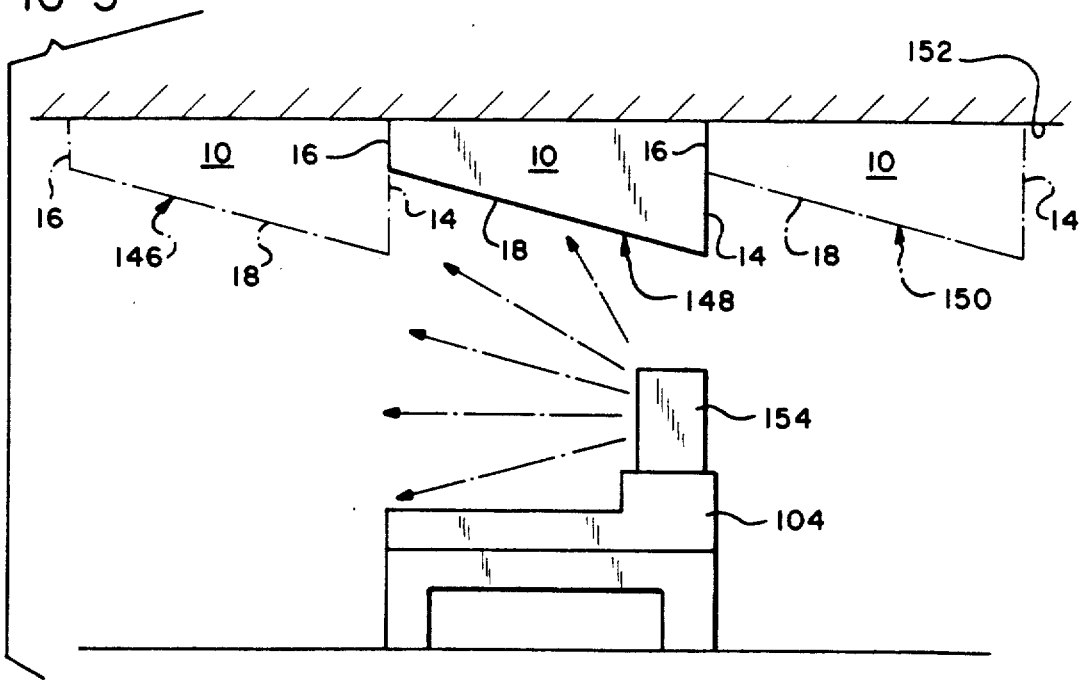
FIG. 5 is a diagrammatic elevational view showing an alternative manner of deploying a plurality of sound absorption units according to the improved method of the invention.
Figure 4:
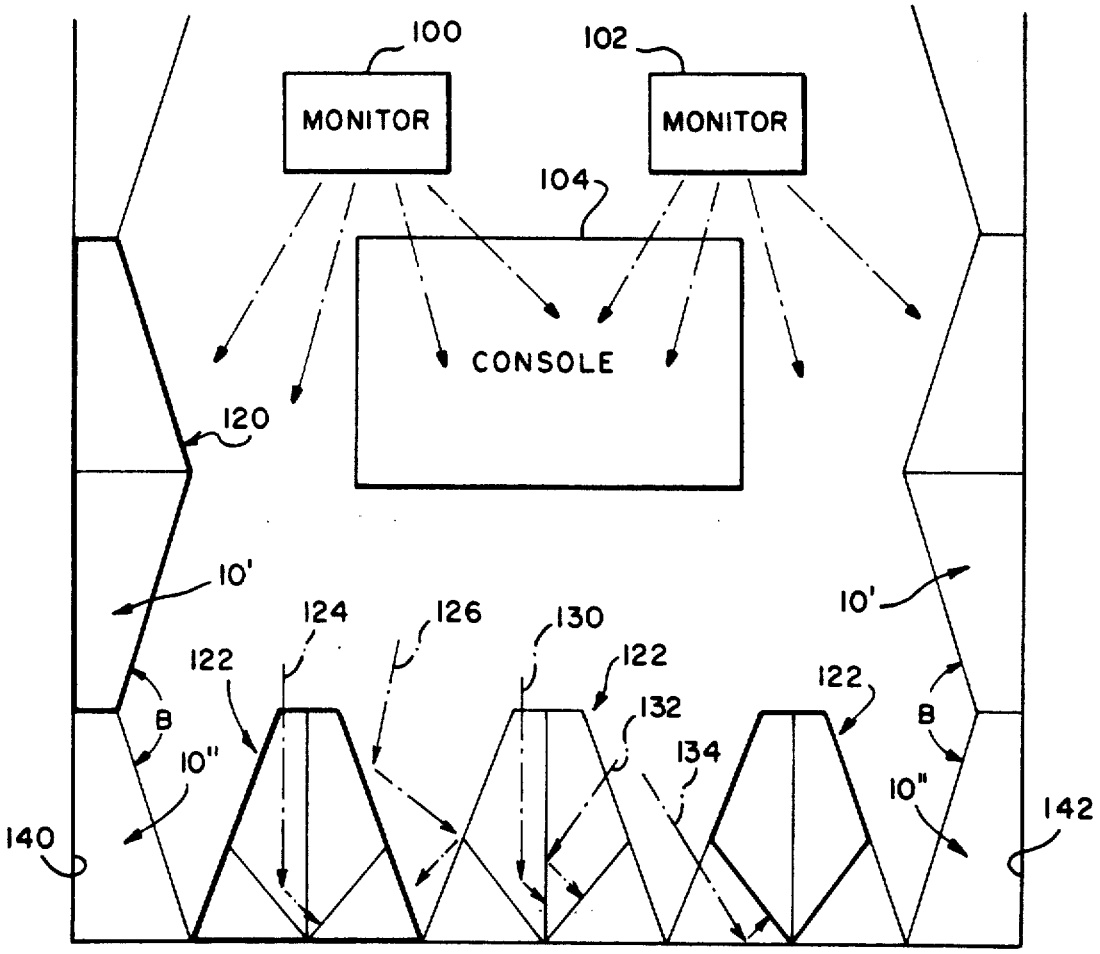
FIG. 4 is a top plan view showing a plurality of modular sound absorption units according to the invention deployed in several different ways according to the practice of the method of the invention.

FIGS. 3, 4 and 5 illustrate the manner of mixing and recording musical sounds in an enclosed room in which a source of music is located. Typically, the music source will include at least a pair of studio or program monitors which are speakers 100 and 102. The speakers 100 and 102 are oriented toward a console 104 that is used to mix the sound received from them.

FIG. 3 illustrates a method of mixing and recording musical sound in which the long, parallel sides 14 of a pair of juxtaposed units 10 are positioned in back to back relationship so that the long, non-parallel sides 18 of those units form a dihedral having a reflex angle A that encompasses the source of music, namely the speakers 100 and 102 as well as the mixing console 104. In the embodiment of FIG. 3 the sound absorption units 10 are disposed upright on end against a wall 106 with the long, non-parallel sides 18 of each of the units 10 oriented in vertical planes to face outwardly into the room at an orientation oblique to the speakers 100 and 102 and the mixing console 104. The short, non-parallel sides 20 of each of the sound absorption units 10 are disposed adjacent to and facing the wall 106.

When adjacent juxtaposed sound absorption units 10 are oriented as illustrated in FIG. 3, the compartments 84 of the juxtaposed units 10 together define a resonance cavity indicated by the heavy outline at 108. The cavity 108 has a resonance of its own, in addition to the resonance of each of the compartments 84 and 86 of each of the sound absorption units 10.

As illustrated in FIG. 3, the initial incident waves of sound indicated at 110 reach the outer surfaces of the exterior sheets 50 forming the sides 18. The sides 18 are oriented obliquely relative to the speakers 100 and 102 forming the sources of the sound, so that some of the high frequency sound is reflected away from the mixing console 104 in oblique directions, as indicated at 112 by the relatively hard pegboard surface of the sheets 50. The low frequency sound, on the other hand, to a large extent passes through the sides 18 of the sound absorption units 10.

Some of the low frequency sound indicated at 114 passes into the trapezoidal prism enclosures within the sound absorption units 10. Part of that sound is absorbed by the fiberglass insulation within the chambers 84 while some of the sound is reflected from the internal partitions 60 thereof, as indicated at 116. Some of this reflected sound 116 is internally absorbed within the insulation within each of the compartments 84, but some of the sound 116 passes through the sides 14 of each of the sound absorption units 10 into the compartment 84 of the other of the sound absorption unit 10. There, it is partially absorbed within the insulation and partially reflected back as indicated at 118 by the interior partition 60 of the other unit 10. The low frequency sound is trapped and almost entirely internally reflected and ultimately absorbed within the sound absorption units 10 position as depicted in FIG. 3.

As illustrated, a high frequency portion 112 of the incident sound 110 is reflected away from the mixing console 104, which serves as the recording unit. The high frequency sound 112 is rapidly attenuated within the room as it travels and thus is not returned to the console 104 as an unwanted recorded input. By reflecting the high frequency sound 112, reverberation within the modular sound absorption unit is reduced. The more pervasive, lower frequency sound 114 does pass through the longest sides 18 of the sound absorption units 10, but progressively loses energy as it is partially reflected and partially passed through the internal partitions 60 within the sound absorption units 10. Moreover, the further the sound travels within each of the sound absorption units 10, the greater it is attenuated by the sound insulating fiberglass layers 62–73.

A plurality of juxtaposed sound absorption units 10 may also be arranged as depicted in FIG. 4 to form anechoic traps. FIG. 4 is a top plan view of a room having a pair of studio monitor speakers 100 and 102 and a mixing console 104. Some of the sound absorption units 10 are arranged in pairs in the manner depicted and described in conjunction with FIG. 3. One such pair is indicated in heavy outline at 120. Other of the sound absorption units 10 are arranged in pairs to form anechoic traps, indicated generally at 122.

The anechoic traps 122 are each formed of a pair of modular sound absorption units 10 positioned back to back with their short, non-parallel sides 20 disposed against each other and with their short, parallel sides 16 residing in coplanar relationship. In the anechoic trap configuration depicted, incident sound waves, indicated diagrammatically at 124, 126, 128, 130 and 132, are reflected and absorbed in anechoic traps 122 as indicated by the arrows showing the manner in which sound is internally and externally reflected and absorbed along and within the anechoic traps 122. An arrangement of anechoic traps 122 as illustrated in FIG. 4 forms a very effective way of absorbing low frequency sound and preventing such sound from being reflected to the mixing console 104.

Still other of the modular sound absorption units 10 are oriented in yet a different arrangement so as to absorb sound in still another manner. Specifically, the sound absorption units 10′ and 10″ are arranged with their short, parallel sides in face to face juxtaposed disposition, and with their short, non-parallel sides disposed against the walls 140 and 142. Each of the pairs 10′ and 10″ of the modular sound absorption units are arranged such that the long, non-parallel sides 18 of the units 10′ and 10″ in each pair form a dihedral having an obtuse angle B encompassing the audio recorder, namely the mixing console 104. Sound passes into the sound absorption units 10′ and 10″ through the sides 18 thereof and is attenuated and reflected within, through, and by the internal partitions 60 in a manner comparable to that depicted and described in conjunction with the arrangement of FIG. 3.

FIG. 5 illustrates still another arrangement of modular sound absorption units 10. FIG. 5 illustrates a plurality of modular sound absorption units 10, indicated separately at 146, 148 and 150, all suspended from a ceiling 152 in the manner described in conjunction with FIG. 2. A music source 154 is disposed atop a mixing console 104 beneath the modular sound absorption units 146, 148, and 150. The units 146, 148 and 150 are positioned together with the short, parallel side 16 of one unit in juxtaposition with a long parallel side 14 of an adjacent unit. The longest sides 18 of the units are parallel to and laterally offset from each other, as illustrated. Again, the various internal compartments 84 and 86 defined within each of the modular units 146, 148 and 150, and the adjacent compartments of the adjacent units 10, reflect and absorb sound in a manner comparable to that depicted and described in conjunction with the embodiment of FIG. 3.

All of the compartments 84 and 86 and the combinations of those compartments within the various juxtaposed sets of sound absorption units 10 serve to internally reflect and absorb sound, particularly low frequency sound, without reflecting that sound back to the recording console 104. Since these different compartments combinations are sensitive to different frequencies, the arrangement of the plurality of sound absorption units 10 in different configurations, as depicted in FIGS. 3, 4 and 5, serves to absorb and attenuate sound frequencies across a very wide frequency bandwidth.

The use of the modular sound absorption units 10 affects the transmission of sound and prevents that sound from being returned as reflected sound to the recording console 104 in three different ways. First, sound waves are deflected and diffused within each sound absorption unit 10 and within juxtaposed sound absorption units 10. Secondly, the different chambers within each sound absorption unit 10, and the compartments formed by the chambers of juxtaposed sound absorption units 10 are resonant to different frequencies. The internal resonance results in rapid attenuation of the sound internally within the sound absorption units 10, without reflecting that sound to the sound recording console 104. Thirdly, the sound is absorbed and attenuated as it passes through the fiberglass and the other materials of which the sound absorption units 10 are constructed.

The sound absorption units 10 can be assembled together and deployed in innumerable different configurations and combinations to allow the recording console 104 to receive only the pure sound of the speakers 100 and 102. Undoubtedly, the various sound absorption units 10 can be assembled together in configurations other than those depicted and described in the drawings. Also, the geometry of the sound absorption units 10 may be varied considerably while still functioning in the manner depicted and described herein.

The use of the sound absorption units is not limited to the mixing and recording of musical sounds. To the contrary, the units can also be used for the treatment of sound in theaters, night clubs, factories, home use, and in other applications and locations where acoustics are important. Accordingly, the scope of the invention should not be construed as limited to the specific embodiment of the sound absorption unit and the specific arrangement of a plurality of units depicted and described, but rather is defined in the claims appended hereto.

I claim:

1. A sound absorption system including at least one portable, modular sound absorption unit comprising a plurality of linear frame members joined together to form a framework with longitudinal linear edges and intersecting transverse linear edges, a plurality of flat, expansive sheets having a multiplicity of apertures therethrough including exterior sheets extending between said edges to enclose a cavity shaped as a right trapezoidal prism and a planar interior sheet extending from a selected one of said longitudinal edges throughout the entire length thereof to one of said exterior sheets that does not intersect said selected one of said longitudinal linear edges, thereby dividing said cavity longitudinally into separate compartments, and layers of sound insulation disposed within each of said compartments.

2. A sound absorption system according to claim 1 further comprising a plurality of modular sound absorption units as aforesaid.

3. A sound absorption system according to claim 2 wherein said trapezoidal prisms of said sound absorption units are all right trapezoidal prisms.

4. A sound absorption system according to claim 3 wherein said trapezoidal prisms are all of uniform size and geometry, each having a short, parallel side and a long, parallel side.

5. A sound absorption system according to claim 3 wherein at least some of said units are positioned together with their long, parallel sides in juxtaposition, whereby said units define sides adjacent to said long, parallel sides which form a dihedral encompassing a reflex angle.

6. A sound absorption system according to claim 3 wherein at least some of said units are positioned together with their short, parallel sides in juxtaposition whereby said units define sides adjacent to said short, parallel sides in juxtaposition, whereby said units define sides adjacent to said short, parallel sides which form a dihedral encompassing an obtuse angle.

7. A sound absorption system according to claim 4 wherein at least some of said units are positioned together with a short, parallel side of one unit in juxtaposition with a long, parallel side of an adjacent unit, whereby the sides of said units extending between said long and short parallel sides are the longest sides of said units and are parallel to and laterally offset from each other.

8. A sound absorption system according to claim 4 wherein at least some of said units are positioned together in mutual juxtaposition with their short, parallel sides disposed in mutual coplanar relationship to thereby form an anechoic trap.

9. A portable, modular sound absorption unit comprising linear members joined together to form a right trapezoidal prism with longitudinally extending sides including a longest side and longitudinal edges formed by at least some of said linear members, flat expansive exterior sheets each having a multiplicity of apertures therethrough secured to said linear members to close all of said sides of said trapezoidal prism, a longitudinal interior partition extending from said longest side to a longitudinal edge opposite said longest side throughout the lengths of both said longest side and said longitudinal edge opposite thereto, and porous layers of sound insulation disposed interiorally of said exterior sheets and in contact with all of said exterior sheets.

10. A modular sound absorption unit according to clam 9 wherein said partition is also comprised of a flat, expansive sheet having a multiplicity of apertures therethrough.

11. A modular sound absorption unit according to claim 10 wherein said linear members are comprised of wood, said flat, expansive sheets are comprised of pegboard and said porous layers are comprised of fiberglass insulation padding.

12. A modular sound absorption unit according to claim 11 formed as a right trapezoidal prism having a long, parallel side, a short parallel side, a long non-parallel side and a short, non-parallel side, and wherein said wooden linear members are disposed externally of said exterior sheets on said parallel sides and on said long non-parallel side to define an exposed framework with said exterior sheets on said parallel sides and on said long, non-parallel side encompassed therewithin.

13. A modular sound absorption unit according to claim 11 wherein said exterior sheets are interiorally lined with fabric.

14. A modular sound absorption unit according to claim 9 wherein said linear members define a right trapezoidal prism having a long, parallel side and a short, parallel side about one third the length of said long, parallel side and separated from said long, parallel side by a distance greater than two times the length of said long, parallel side.

15. A modular sound absorption unit according to claim 14 wherein said partition has a width about one half the distance of separation between said parallel sides of said right trapezoidal prism.

* * * * *